US007156748B2

(12) United States Patent
Burke

(10) Patent No.: US 7,156,748 B2
(45) Date of Patent: Jan. 2, 2007

(54) GOLF TRAINING DEVICE AND METHOD

(76) Inventor: James Burke, 43 Gabb Rd., Bloomfield, CT (US) 06002

( * ) Notice: Subject to any disclaimer, the term of this patent is extended or adjusted under 35 U.S.C. 154(b) by 19 days.

(21) Appl. No.: 11/076,883

(22) Filed: Mar. 10, 2005

(65) Prior Publication Data

US 2005/0202896 A1 Sep. 15, 2005

Related U.S. Application Data

(60) Provisional application No. 60/553,243, filed on Mar. 15, 2004.

(51) Int. Cl.
*A36B 69/36* (2006.01)

(52) U.S. Cl. ..... 473/276; 473/207; 473/212; 473/219; 473/226

(58) Field of Classification Search ..... 473/266, 473/269, 275, 276, 277, 207, 212–215, 217, 473/226, 227, 229, 461, 464; D21/791
See application file for complete search history.

(56) References Cited

U.S. PATENT DOCUMENTS 2,022,910 A * 12/1935 Hanley ..... 473/214
3,740,052 A * 6/1973 Arkin ..... 473/214
3,858,881 A * 1/1975 Hurwitz ..... 473/553
5,476,257 A * 12/1995 Bobby ..... 473/464
D372,064 S * 7/1996 del Barrio ..... D21/791
5,618,040 A * 4/1997 Parten ..... 473/461
5,865,685 A * 2/1999 Thomas ..... 473/213
6,471,598 B1 * 10/2002 Takase ..... 473/212
6,827,654 B1 * 12/2004 Meyer ..... 473/212

* cited by examiner

*Primary Examiner*—Nini F. Legesse
(74) *Attorney, Agent, or Firm*—Alix, Yale & Ristas, LLP

(57) ABSTRACT

The golf training device comprises an arm band for attachment on the lead arm, above the elbow, and a resilient cord securable at one end to the arm band and having means at the other end for selectively attaching the cord on a golf club below the grip. A general method aspect of the invention comprises attaching an arm band to the golfer's leading arm above the elbow, connecting a resilient cord from the arm band to an attachment means on the club below the grip, assuming a stance by holding the grip of the club with both hands so that the club shaft extends in front and between legs of the golfer, and extending the hands to stretch the cord between the arm band and the shaft until the club head is in a desired position. The golfer maintains the stretch in the cord while moving the club back and forth in either a short or full swing. The training aid has several adjustable features that enable personalization as to fitting the body size and type of each golfer, and repositioning from use to use as the golfer's swing improves.

8 Claims, 9 Drawing Sheets

GOLF TRAINING DEVICE AND METHOD

RELATED APPLICATION

The present application claims priority under 35 U.S.C. Sec. 119(e), from U.S. App. Ser. No. 60/553,243 filed Mar. 15, 2004.

BACKGROUND OF THE INVENTION

The present invention relates to a golf training device and method, and in particular, to a device and method for training a golfer to maintain the golf club and release the clubhead at the proper time and "on plane".

The golf swing is one of the most complex and difficult movements in all of recreational sports. Numerous devices and drills have been developed over many years to help golfers visualize, follow, or strengthen proper movements. Some devices or drills focus on isolated parts of the body (such as hands, arms, torso, or hips), whereas others focus on parts of the swing (such as stance, takeaway, backswing, transition, release, impact, or follow-through). Very few devices provide helpful feedback throughout the swing.

A particularly difficult movement for most golfers, even highly accomplished golfers, is maintaining the golf club, "on plane" until and while the club is "released" for and through impact. From a top of backswing position, the torso must pivot without changing the spine angle at address, while the arms follow the torso without being pushed forward, and the wrists maintain the angle set at the top of the backswing, until centrifugal force releases the wrist angle such that at impact, the left shoulder is raised, the spine is tilted back, the head is behind the ball, and the left arm, back of the left hand, and club forms a substantially straight line from the shoulder to the ball. For this proper alignment, the club must remain substantially "on plane"; a correct follow through is evidence of a correct release and impact alignment.

One source of difficulty in performing or learning the proper swing, is that the torque produced by the weight of the club is felt by the golfer at a considerable distance from the golfer's grip, i.e., the center of gravity of the club is well down the shaft, near the clubhead. Especially for novice and beginning golfers, this can make the downswing feel like the club is controlling the golfer, instead of the golfer controlling the club on the proper swing plane. The hands must control all the weight of the club (and thus the torque) at the grip, which is farthest along the shaft from the club head.

Presently, no inexpensive, portable, personalized drill or device is known to the inventor that actively induces the desired body pivot and rotation of arms, hands and club to keep the club on plane to, through, and after impact.

SUMMARY OF THE INVENTION

Accordingly, it is an object of the present invention, to provide an inexpensive, portable, personalized device and associated method that actively induces the desired movements of body, arms, and hands to keep the club on plane to, through, and after impact.

In a general aspect, the golf training device comprises an arm band for attachment on the lead arm, above the elbow, and a resilient cord securable at one end to the arm band and having means at the other end for selectively attaching the cord on a golf club below the grip.

A general method aspect of the invention comprises attaching an arm band to the golfer's leading arm above the elbow, connecting a resilient cord from the arm band to an attachment means on the club below the grip, assuming a stance by holding the grip of the club with both hands so that the club shaft extends in front and between legs of the golfer, and extending the hands to stretch the cord between the arm band and the shaft until the club head is in a desired position. The golfer maintains the stretch in the cord while moving the club back and forth in either a short or full swing.

Such a simple, easy to use, yet sophisticated training aid has several adjustable features that enable personalization as to fitting the body size and type of each golfer, and repositioning from use to use as the golfer's swing improves.

One adjustment is simply to increase or decrease the effective length of the cord for a given connection point on the shaft to accommodate an individual's body build and stance, as by looping the upper end of the cord around an arm band or attaching the cord to the arm band with a buckle or the like. This same adjustment means can also be used to increase or decrease the nominal tension in the cord when the golfer assumes a stance for practice swings or addresses the ball preparatory to hitting the ball while using the device.

Another adjustment provides for moving the control point much closer to the clubhead, while maintaining the ability to swing the golf club fully. Whereas the golfer will always hold the club at the grip, the effective weight of the club is controlled by the location of the connection of the cord on the shaft. The closer to the grip, the greater the torque felt by the hands, and the closer to the clubhead, the less the torque felt by the hands. Because the resilient cord extends in tension between a connection at a preselected location on the shaft and a connection at the upper portion of the golfer's lead arm, the torque felt by the hands changes dynamically during the entire swing. While the golfer is "on plane", the club has an apparent weight that remains essentially constant. However, if the golfer deviates from such plane, the cord will stretch or relax, thereby changing the apparent weight. The golfer trains his or her swing by trying to maintain a constant apparent weight or feel of the clubhead during the swing. The inventive device assures that at least the release to, through and following impact will be essentially correct if the cord tension is maintained (not stretched or relaxed) during this portion of the swing.

In a corollary aspect of the invention, the resiliency of the cord provides instant feedback on deviations from a correct swing, by inducing corrective movement, especially at low swing speeds. If the club is drifting outside the proper plane or release, the tension in the cord increases and when felt by the golfer, a responsive correction can be transmitted to the club. When repeated many times, the golfer eventually produces the correct motion associated with a given location of the connection of the cord to the shaft near the clubhead. In subsequent training sessions, the connection point is moved closer to the hands, and as the swing improves the golfer will make a correct swing even with the connection point high up on the shaft (simulating a condition that is nearly that of a club without the device).

As a further adjustment feature, the connection of the cord to the shaft can be offset at any desired angle, relative to the axis of the shaft. This affects the point during the release portion of the swing, when the clubhead begins to close while on the proper plane. Whereas the location of the connection of the cord on the shaft strongly influences the swing plane (i.e., the plane defined by the axis of the shaft, or more precisely, the plane defined by a line from the hands to the "sweet spot" on the club head) the offset of the cord relative to the shaft axis strongly influences the apparent rotation of the clubhead around the shaft axis, and thus the rate at which the club face closes toward perpendicularity with the target line at impact.

The release of the golf club properly is one of the most dynamic and elusive feelings in sport, thus, one of the toughest to learn. The device creates this feeling and enables the user to find it much more easily than by just swinging a golf club. If the golfer feels it more, then it is more easily learned. It creates torque in the hands at a slow speed similar to centrifugal force created by swinging the golf club at normal or higher speed. At the slower speed, the golfer can now learn more easily by feeling how and why the release of the golf club is at the time when gravity and centrifugal force both act on the mass of the golf club, during the down swing.

The device eliminates a breakdown of solid angles at the top of the backswing. At the top of the backswing, the golfer tries to maintain a support position, under the golf club set on a desired swing plane. As the golfer turns on an axis, the support position comes down and around this axis dynamically. As this happens, the golf club mass is being pulled by centrifugal force by the turning on the axis and by gravity as the club drops. This force is supported by the hands. The three elements of the release, the club moving around the axis of the spine and angle, the club coming down by gravity, and rotation of the club shaft axis back to square, all must work in harmony, and on a desired swing plane and path. All of this defines the release.

The inventive device aids in eliminating an excessively long backswing, an excessively narrow swing, a bent lead elbow, the over the top move, the excessively inside backswing, and the excessively flat backswing. It also identifies the proper chipping motion, by helping eliminate "flipping" of the clubhead.

The device aids in a proper grip by producing a torque on the hands that requires the user to support that torque with a proper grip and alignment of the hands. This feeling is coupled with the visual reinforcement of the club following the proper swing plane.

The inventive device and associated method can thus be used in an unhindered manner, for full and short swings, at full or slow speed.

BRIEF DESCRIPTION OF THE DRAWINGS

The preferred embodiments of the invention will be described with reference to the accompanying drawings, in which.

DESCRIPTION OF THE PREFERRED EMBODIMENT

Figure 1:
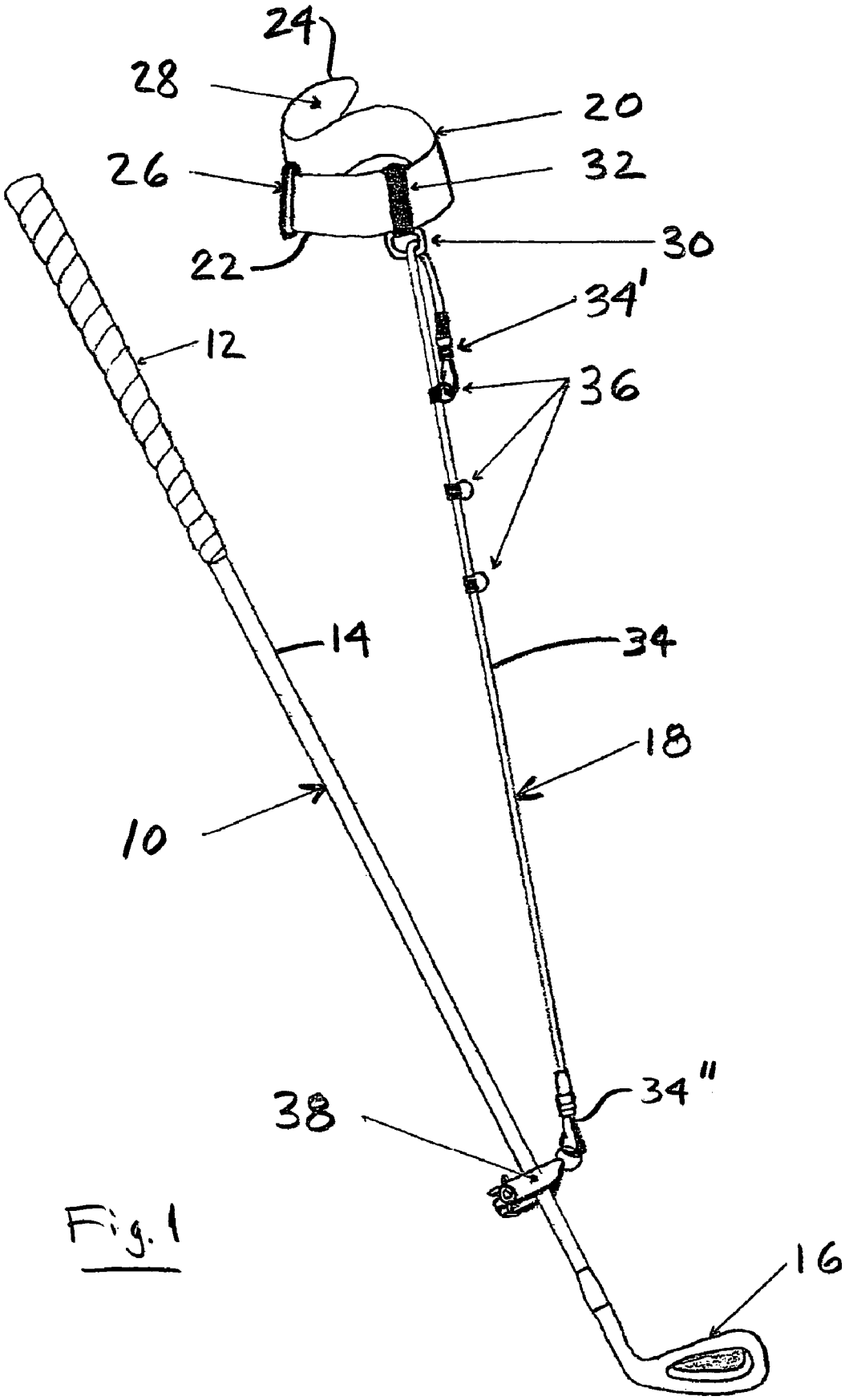
FIG. 1 shows the inventive device as attached to a golf club.

FIG. 1 shows a conventional golf club 10 having a grip 12 at one end of the shaft 14, and a clubhead 16 attached to the other end of the shaft through a hozel. The inventive device 18 is shown unattached to the user for illustrative purposes. The device comprises a band 20 or the like for attachment to the upper portion of a golfer's lead arm, i.e., the left arm of a right handed golfer and the right arm of a left handed golfer, immediately above the elbow, preferably around the biceps and triceps muscles. The band 20 is generally flexible, with a convenient attachment means for joining the opposed ends 22, 24 and retaining the band in position during vigorous movement, such as a metal loop 26 and hook and loop (Velcro) 28 or a buckle. The band may be lined with neoprene or other soft material for the comfort of the user.

The band has another attachment means, such as a D-ring 30 or the like with associated stiffener or support bar 32 between the ends, whereby a stretchable, resilient 34 cord having clip means 34', 34" at its ends can be looped through the attachment means 30 and preferably secured to itself though an adjustable retainer or a series of D rings 36 or the like. Alternatively, the cord may have a clip or the like attachable directly to the armband, or the arm band 20 can have a buckle or friction clip for securing the cord at any desired position from the upper free end. The other end of the cord 34 is attachable to the golf club, at any location below the grip 12. Attachment is preferably by means of a clip device 38 that can easily be disengaged and relocated along the shaft 14. Additionally, the clip should be rotatable relative to the shaft axis.

The adjustable retainer 36 in the embodiment illustrated in FIG. 1 not only adapts the cord to the stature of the user, but also can change the tension in the cord for adaptation to the skill level or problem to be addressed, for individual golfers. The ability to adjust the position of the clip attachment 38 on the shaft can also be used in conjunction with the relocation of the other clip 36 associated with the upper end of the cord, to assure proper fitting for each golfer.

Figure 2A:
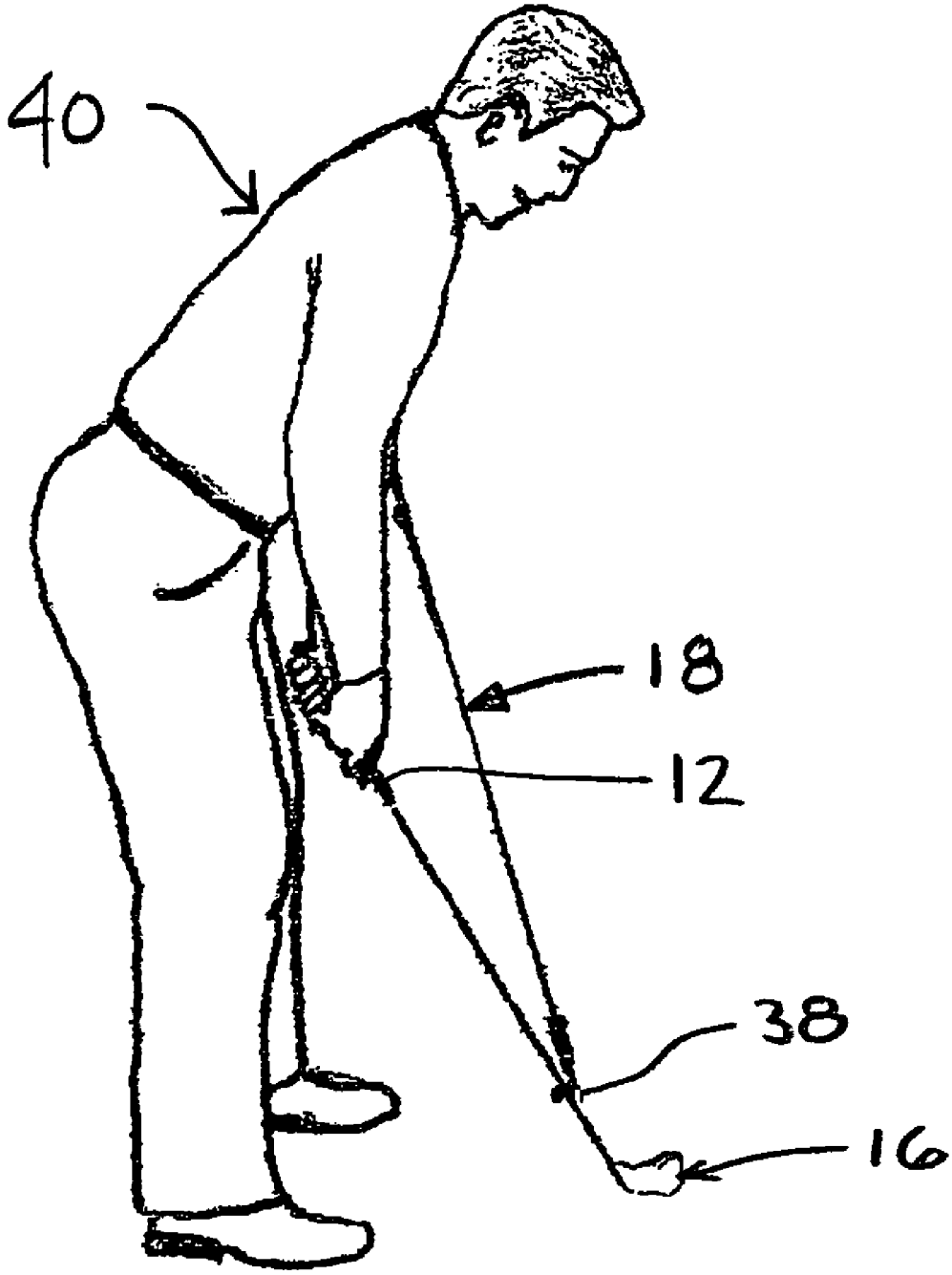
FIGS. 2A–2C show the club and training device in the configuration of FIG. 1, but connected to and held by a right handed golfer in a proper stance, from the back, face, and front, respectively.
Figure 2B:
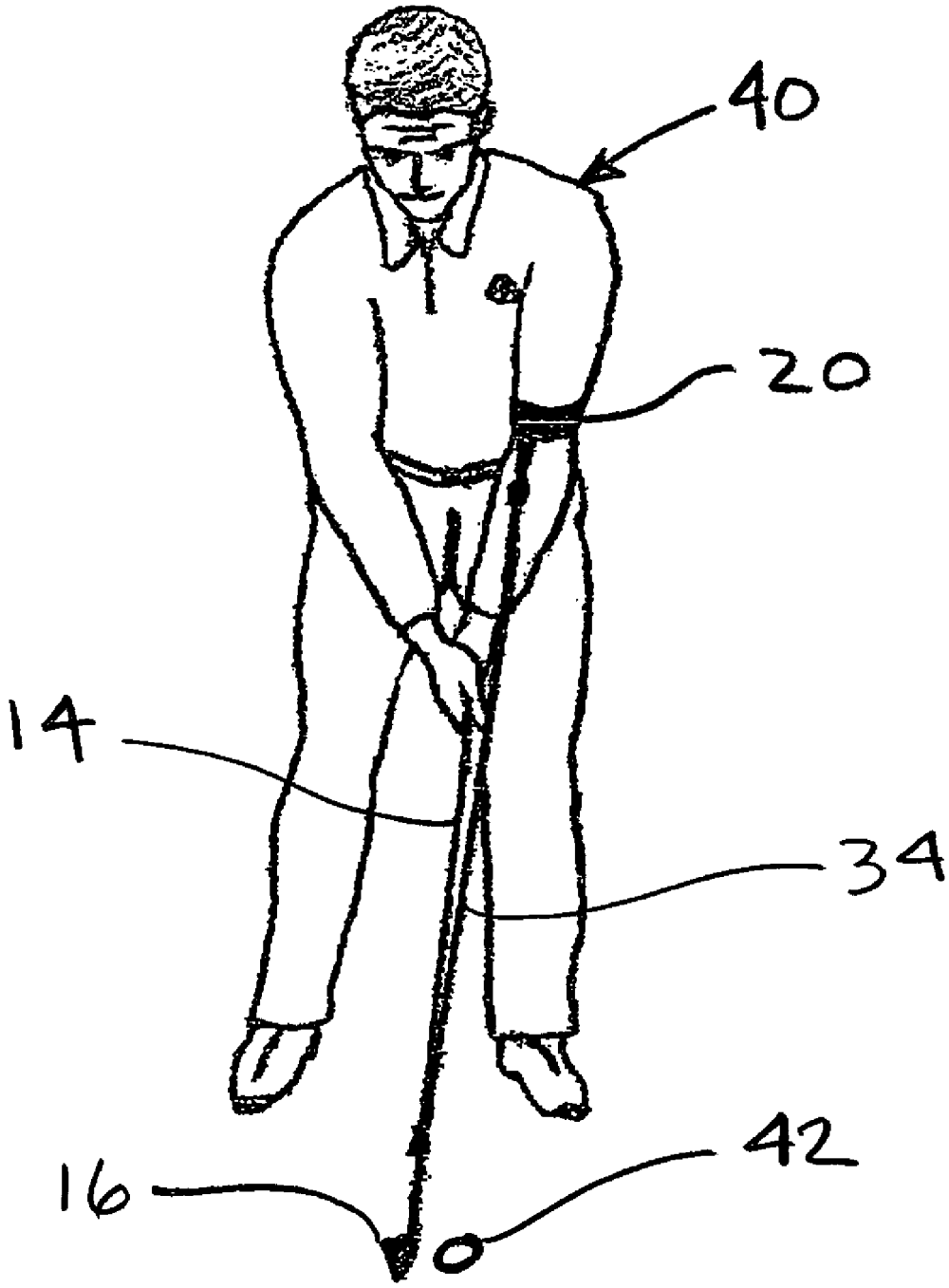
Figure 2C:
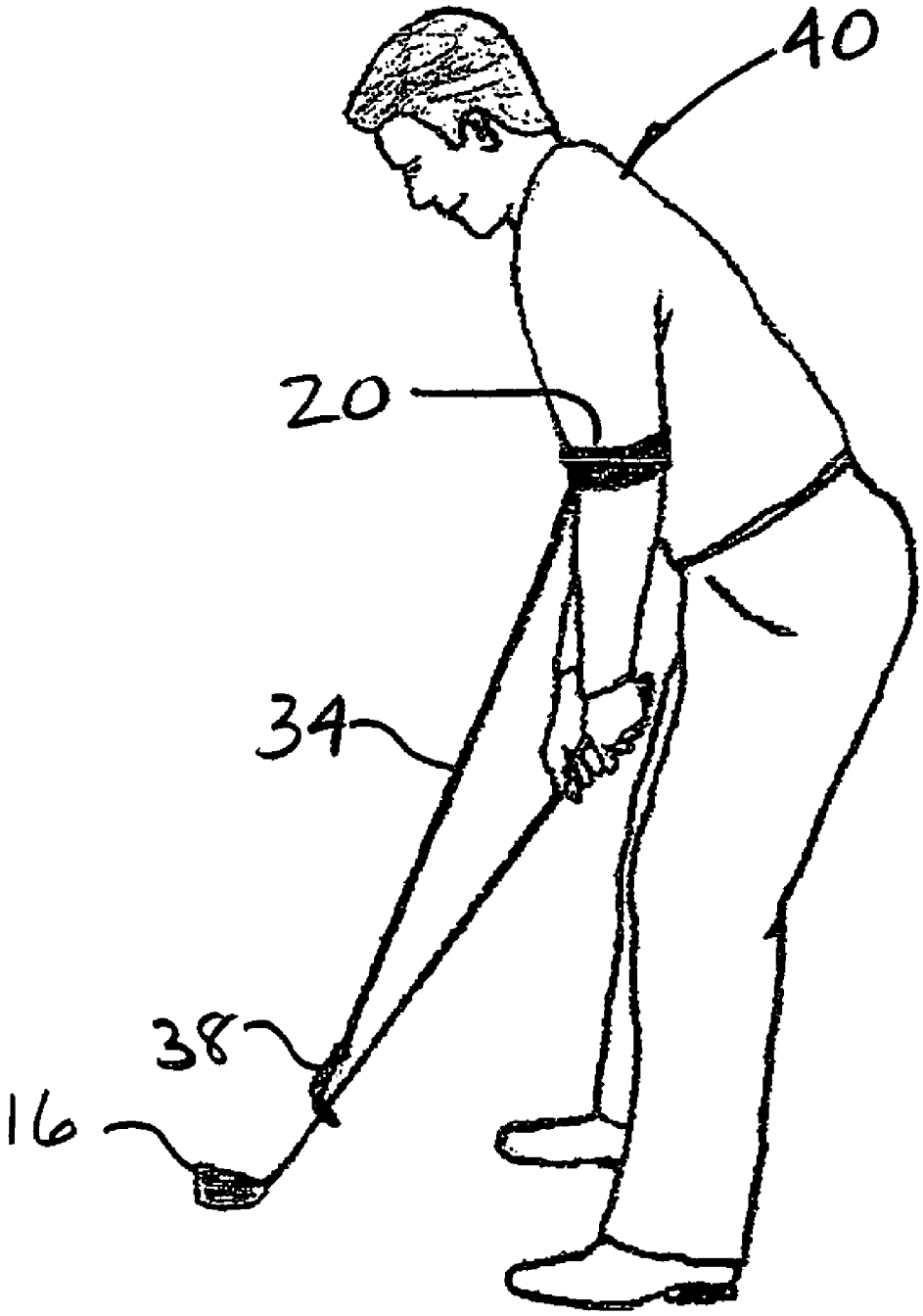

FIGS. 2A–2C show the club 10 and training device 18 in the configuration of FIG. 1, but connected to and held by a right handed golfer 40 in a proper stance. With the connection 38 to the shaft closer to the club head 16 than to the grip 12, a relatively high degree of control can be exercised over the club head. FIG. 2B shows the device in place, with the golfer addressing a ball 42. As shown facing the golfer, the connection 38 of the cord 34 to the shaft 14 aligns the cord very nearly parallel to the shaft axis, but as will be described in greater detail below, the connector can preferably be selectively oriented so that the axis of the cord forms a greater angle with the axis of the shaft. Typically, a novice to intermediate golfer who has difficulty closing the club face properly would set the connection point 38 of the cord toward the target relative to the shaft, whereas an advanced player who closes the clubhead too quickly would set the connection point at the other side of the shaft.

Figure 3A:
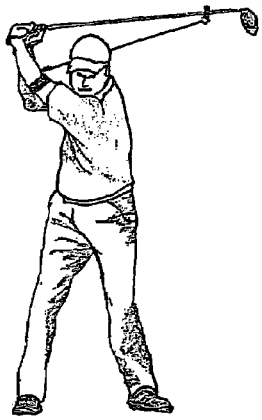
FIGS. 3A–3C show the three positions of a golfer using the device to improve a full swing.
Figure 3B:
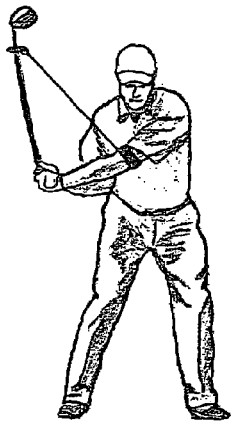
Figure 3C:
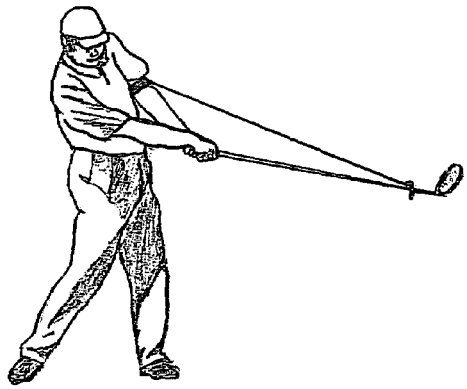

FIGS. 3A, 3B, and 3C show the golfer's movement from the top of the backswing through release on a full swing as guided by the inventive device 18.

Figure 4:
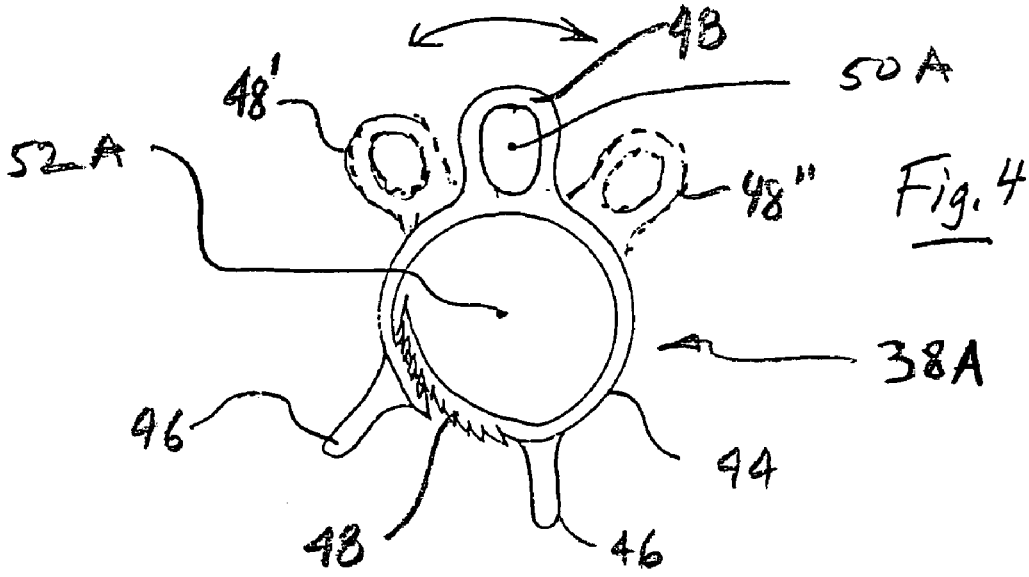
FIG. 4 shows one embodiment of a connector for attaching the cord to the shaft of the golf club.

FIG. 4 shows one embodiment of a connector clip 38A for attaching the cord to the shaft. The clip has an attachment ring 44 that can be spread apart using the tabs 46 to accommodate insertion of the shaft, and then as the tabs are pulled toward each other, the opposed saw tooth structure 48 tightens the ring around the shaft, while preventing expansion of the ring during use. The cord attachment eyelet 48 is shown having a through axis 50 that is parallel with the ring axis 52. It can be appreciated that, whereas the ring axis 52 will always be coaxial with the shaft axis, the eyelet axis 50 can be offset from the shaft axis by the user selecting the angular orientation 48, 48" by which the clip is attached to the shaft. Thus, the attachment of the cord to the eyelet 48 could be relatively forward of the shaft axis, or relatively rearward of the shaft axis, in relation to the clubhead. This affects the dynamic balance of the club and the clubhead closing characteristics, which can thus be adjusted.

Figure 5:
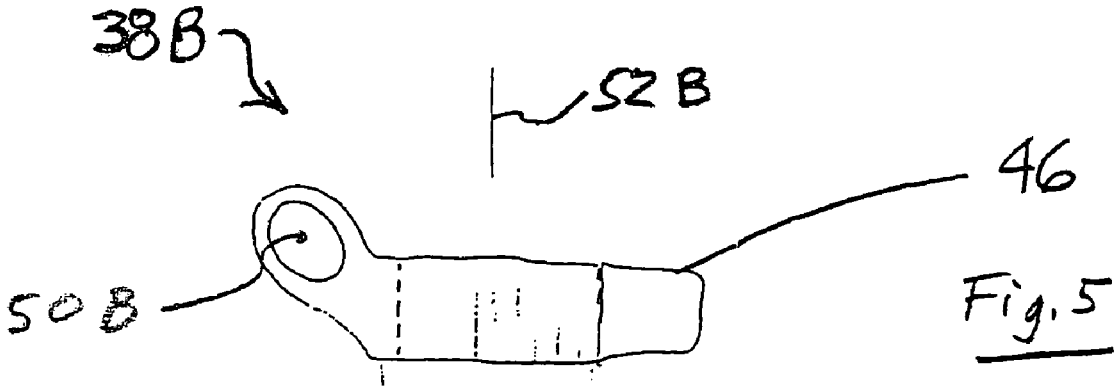
FIG. 5 shows another embodiment of a connector for the shaft.

FIG. 5 shows a variation 38 whereby the eyelet axis is transverse to the attachment ring axis. As with the previous embodiment, the clip can be installed at a variety of angular positions about the shaft axis.

The frictional engagement with the shaft can be increased by providing a rubber lining or the like between the ring of the clip and the shaft.

Figure 6A:
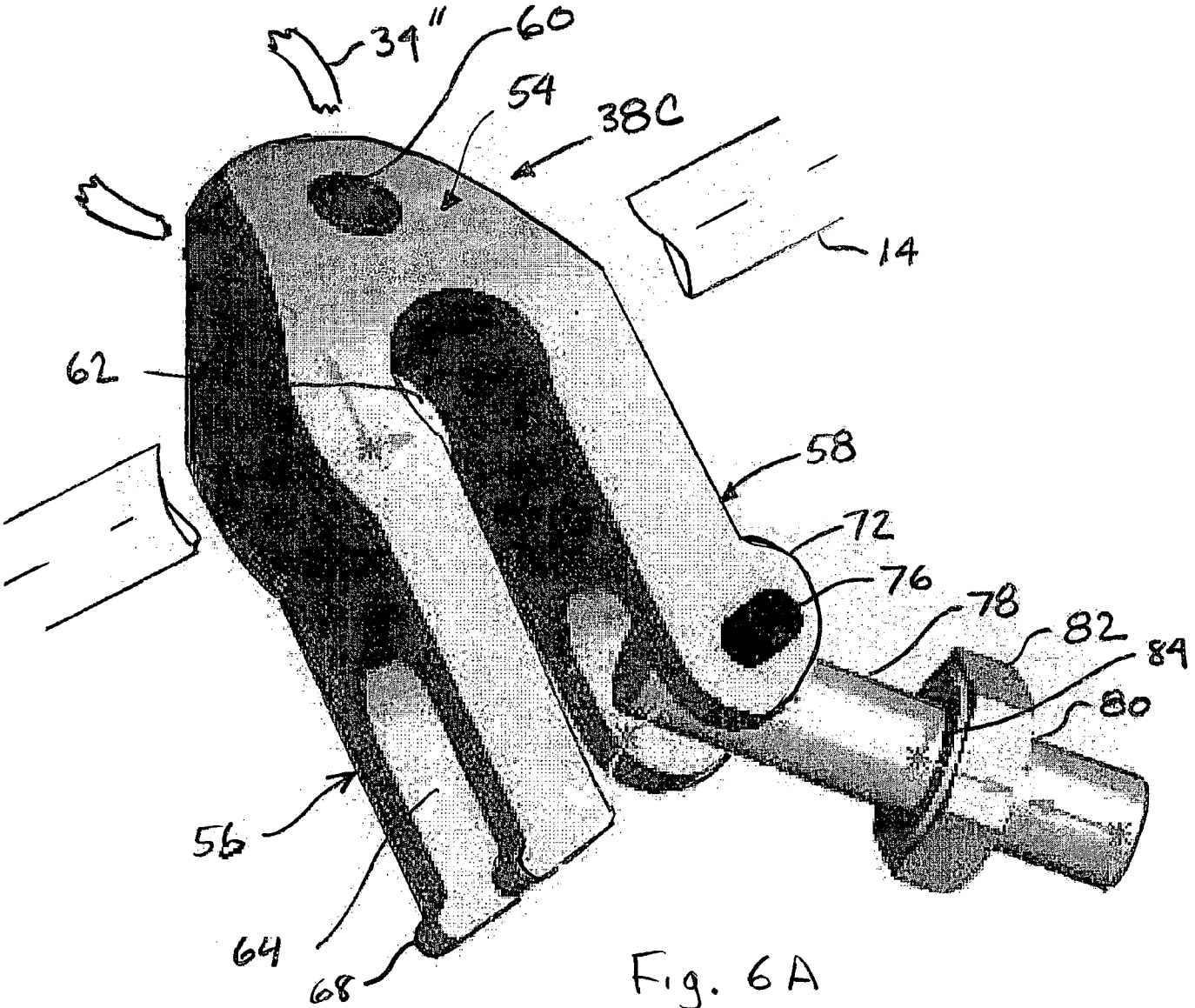
FIGS. 6A–6C show a third embodiment of a connector for the shaft.
Figure 6C:
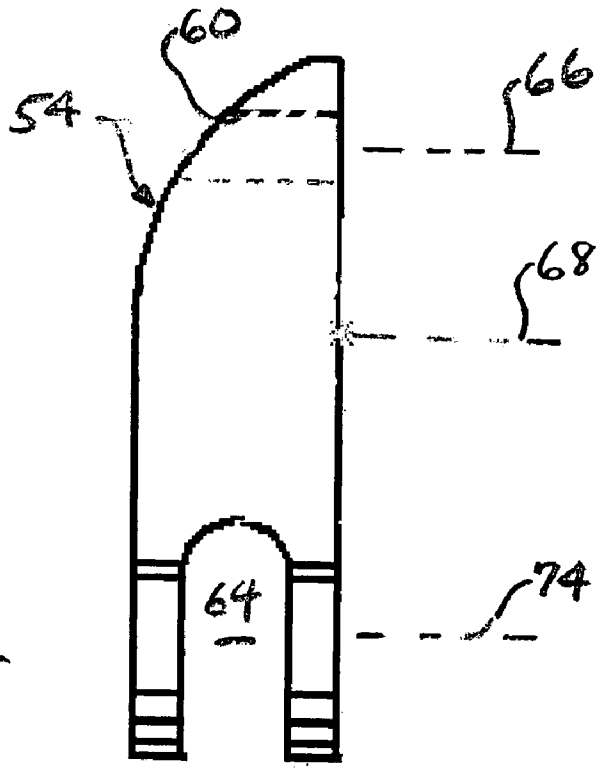
Figure 6B:
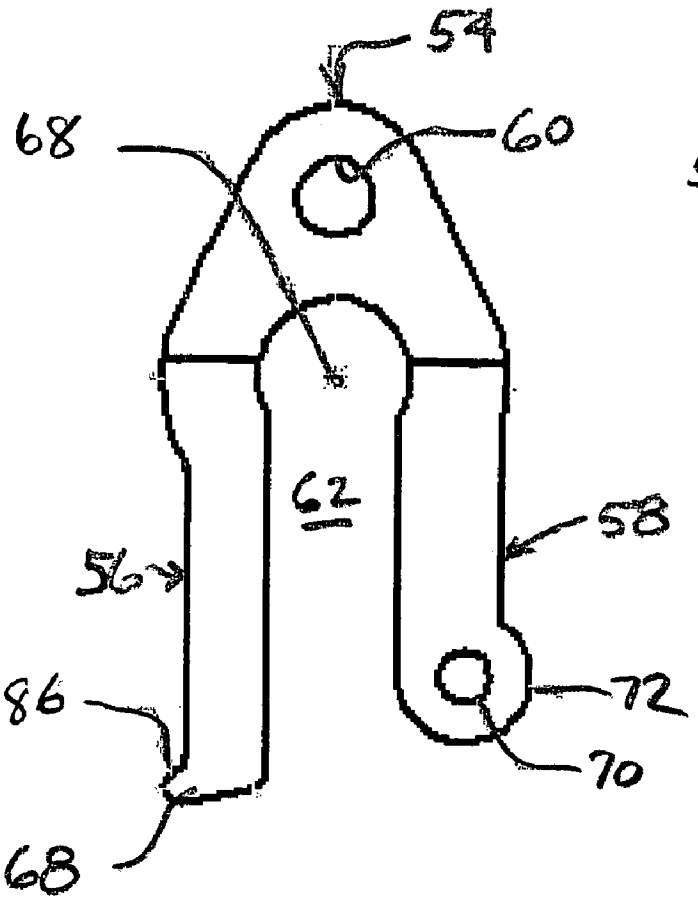

FIG. 6A is a perspective view and FIGS. 6B and 6C are elevation views front and side of another embodiment of the connector 38C between the lower portion 34" of the cord and the golf shaft 14. The connector has the general shape of a yoke, with an upper, body portion 54 and a lower portion having two pairs of legs 56, 58. The body portion is preferably in the shape of a four-sided pyramid, with a through bore 60 passing between one set of opposite faces. This bore defines a body axis 66. The lower portion is integral with and extends rigidly from the body, whereby the legs define two orthogonal, intersecting passages 62, 64. The first passage 62 has the shape of a keyway, with an enlarged opening at the junction of the body and the leg portions. This opening has an axis 68 that is parallel to the body axis 66. The other passage 64 is formed by opposed, arch like cutouts in the lower portion. The pair of arbitrary front legs 56 have paw-like projections 68 extending away from the other, arbitrary back pair of legs 58. The back legs have coaxial through bores 70, preferably on enlarged bosses 72, along another axis 74 parallel to the body axis 66.

The through bore 70 on the boss permanently supports a pivot pin 76. A bolt 78 has one end mounted on the pivot pin for selective movement in a first position whereby the bolt passes through the passage 62 and arches 64, and a second position (as shown) whereby the bolt swings away to permit insertion of the club shaft 14 through the passage 62 into the enlarged portion of the keyway passage. The free end of the bolt is threaded 80, and carries a hex, wing nut or the like 82, with associated washer 84. Once the shaft 14 is in the enlarged opening 62, the nut 82 is tightened to urge the washer 84 against both front legs above the paws, at 86. The shaft is thus tightly held by the connector, preventing relative rotation between the shaft and connector. It should be appreciated that before the nut is tightened on the bolt, the connector can be rotated about the shaft axis to any angular orientation. After tightening, the washer 84 bears against both front legs, adjacent (immediately above) the paws, such that the paws prevent the bolt from pivoting out of the passage even under the most vigorous golf swing.

The hole 60 in the body is adapted to receive a ring or other end-effector 34" associated with the cord member 34. The ring axis and the bolt axis will be substantially parallel, and the cord when straight will form substantially the same angle with the shaft axis, as the angular orientation of the connector relative to the shaft as set when the nut is tightened.

Thus, the connector has a passage for receiving the club shaft and means for expanding and contracting the passage for receiving and tightening the passage onto the shaft at any selected angular orientation of the connector relative to the shaft. Means, such a distinct passage, is provided for attachment of a cord to the connector. Alternatively, another boss, mounting pins, or the like can be provided, to which is attached or attachable, a swivel clip or the like for mating with a swivel clip or ring at the end of the cord.

The passage for receiving the shaft is preferable a key way and the means for expanding and contracting are preferably an associated pivoting bolt with nut.

Figure 7:
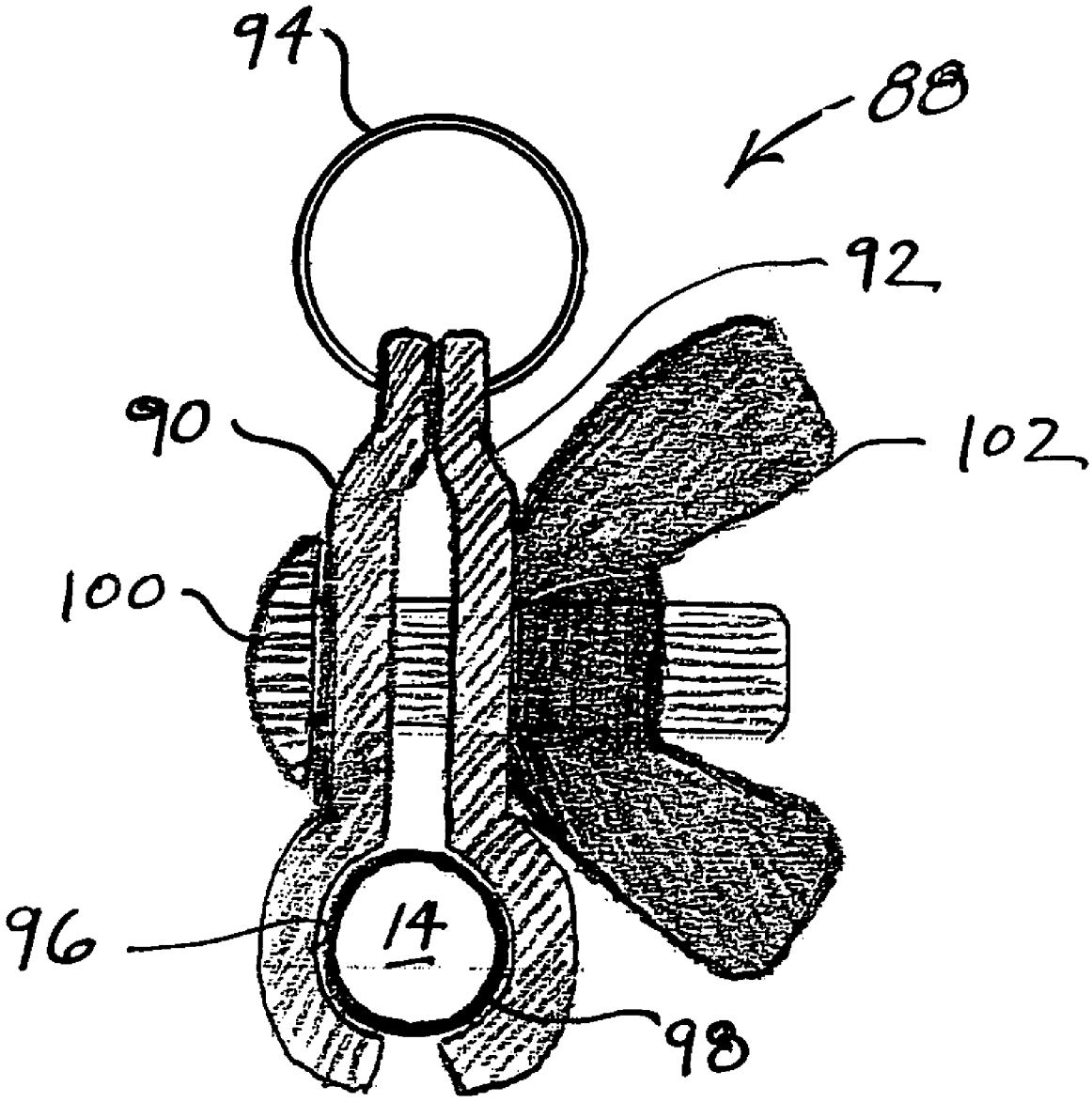
FIG. 7 shows a fourth embodiment of a connector for the shaft.

FIG. 7 shows another connector 88 having two mirror-image clamp plates 90, 92 with a ring 94 passing through the upper ends and a cylindrical clamping wall 96, 98 formed at the lower ends for receiving and tightly engaging the shaft. The bolt 100 and nut 102 arrangement passing through the central portion opens and closes the clamping wall for the shaft.

The following summarizes the instructions for using the inventive device: Attach the connector loosely to the shaft at any axial position and rotational orientation. Place the armband just above the left elbow with a snug fit, and position it so the clip ring is at the biceps, toward the club. Clip one end of the flexible cord to the armband and the other to the shaft connector. Tighten the shaft connector and feel the tension when placing the club in the address position. Adjust to the desired tension and angular orientation of the connector by sliding and rotating the shaft connector up or down the shaft. At the desired condition, tighten the connector on the shaft. Be sure that when you are in the address position with your usual grip on the club, the tension produced by the connector settings produce a square club face behind the ball or along the imaginary line of flight.

A key feature of the invention is that the cord is flexible and expands considerable during the modeled swing. Upon setup the cord is extended, up to about ten inches greater than its nominal, unstretched length. As the player proceeds through the back swing and the left arm reaches approximately parallel orientation relative to the ground, the cord retracts to some extent, thereby helping the player establish the proper lag angle between the club shaft and the left forearm. The player must then consciously maintain this angle through to the end of the back swing or else the shaft will "collapse" with the cord returning to an unmentioned neutral length. Therefore, as the player maintains the angle and begins the down swing, the cord maintains tension and prevents the angle from prematurely releasing. At the top of the back swing and during the early down swing, the cord is still stretched a few inches. As the player transitions toward release, the right elbow comes down in front of the right hip, while maintaining tension in the cord, and as the player approaches the impact position, the hips rotate and the centrifugal force releases the club, thereby stretching the cord even more, to an extent greater than the set up position. As the player proceeds past impact the tension on the cord helps the player properly square and the close the club face, while maintaining some tension in the cord to prevent the golfer from totally collapsing with the hands.

As a practical matter, the cord should be stretchable by at least about six inches. Theoretically, only a portion of the attachment between the arm and the shaft needs to be stretchable by at least six inches, so that you could have short rigid rods at one or both ends of the cord. Thus, in the present context, "resilient cord" should be understood as including a thin, elongated member that is either homogeneous or non-homogeneous, so long as all or a portion is resilient, i.e., when one end of the member having nominal length is fixed and the other end is pulled (tensioned), the overall length increases and a restoring force is produced that will return the member to its nominal length when the pulling force is release.

Also, the attachment point for the cord on the arm band, is preferably on the biceps portion of the upper arm, not on the triceps.

The inventive device will give positive feedback immediately. To swing the golf club with control, you must first know what proper control feels like. The inventive device provides that feeling of control. The less correct the user's natural swing, the more tension is needed in the cord to urge the club toward the proper plane or release action. As you become better at the golf swing, you can progress to less support by clipping on a shorter, lighter tension cord.

The inventive device thus helps to train and maintain a square clubface on a substantially constant plane, along an inside delivery path to the ball. It quickly shows the action of the arms, hands and clubface during the proper release of the golf club through impact, keeping the club on an inside path, with an efficient delivery of power. This produces a pro's "feel", in part because the club is not released too early in the down swing. The device also eliminates the "chicken wing" finish observed on most high handicap golfers. Moreover, it also restrains the length of the back swing, thereby reducing the tendency to lift or otherwise move the club off the proper plane near the top of the back swing. It also eliminates "casting" of the club by helping the golfer retain the angle of the club shaft relative to the left (lead) arm, for a longer duration in the down swing. Furthermore, the use of the device gives the golfer immediate feedback on proper mechanics. It reveals and thus helps overcome the pushing out of the right shoulder from the top of the backswing that produces the "over the top" movement that tends to force the clubhead onto an off-plane, oblique path across the golf ball, creating pulls or slices. The device also creates the proper grip and support underneath the golf club at the top of the golf swing, by forcing the user to maintain the proper hinge position at the top of the golf swing.

Unlike most training aids, the golfer can use this device on any club, from sand wedge to driver, and swing unhindered throughout the entire swing. Thus, full shots can be hit with any club. Furthermore, technique for part shots, even so called "chip shots", can be improved because the device encourages the back of the lead hand to remain flat, rather than bending or flipping the wrists. Importantly, any golfer of any skill level can initially repeat a drill or swing with a high degree of assisted control (by attaching the cord close to the club head) and over time, gradually move the connector toward the grip, thereby reducing assistance until the desired motion is fully ingrained.

The invention claimed is:

1. A golf training device usable by a golfer in making a swing while gripping a golf club with a leading hand and a trailing hand, comprising:

an arm band attachable on the lead arm, above the elbow;

an elongated resilient cord securable at one end to the arm band, and securable by a connector at the other end to the club below the grip, at any selected angular orientation, said connector having a passage for receiving the club shaft, means for tightening the passage onto the shaft at any selected angular orientation of the connector relative to the shaft, and means for attachment of a cord to the connector, wherein the passage for receiving the shaft is an elongated slot and the means for tightening include means for expanding and contracting the slot with a pivoting bolt with nut.

2. A golf training device usable by a golfer in making a swing while gripping a golf club with a leading hand and a trailing hand, consisting essentially of:

an arm band attachable on the lead arm, above the elbow;

an elongated resilient cord securable at one end to the arm band, and securable at the other end to the club at any selected location below the grip, and at any selected angular orientation relative to the club shaft; wherein the connector has the general shape of a yoke, with an upper, body portion and a lower, leg portion;

the body portion is a four-sided pyramid, with a through bore passing between one set of opposite pyramid faces and defining a body axis;

the lower portion is integral with and extends rigidly from the body portion, whereby two orthogonally intersecting passages are defined, the first passage having the shape of a keyway, with an enlarged opening at the junction of the body and the leg portions and an axis that is parallel to the body axis, and the orthogonal passage is formed by opposed, arch like cut outs in the lower portion;

wherein the arch like cut outs form a pair of front legs each having paw-like projections extending parallel to the axis of the orthogonal passage, and a pair of back legs have coaxial through bores, preferably on enlarged bosses, along another axis parallel to the body axis;

a pivot pin supported in the through bores of the back pair of legs;

a bolt having a free end mounted on the pivot pin for selective movement in a first position whereby the bolt passes through the passage and arches, and a second position whereby the bolt swings away to permit insertion of the club shaft through the other passage into the enlarged opening of the keyway, the fee end of the bolt including threads and a wing nut with associated washer, for urging the washer against both front legs immediately adjacent the paws to tightly secure the connector to the shaft.

3. The device of claim 2, wherein the cord is substantially homogeneous between the arm band and the shaft.

4. The device of claim 3, wherein the cord is elastically stretched in tension between the arm band and shaft while the golfer addresses the ball.

5. A method for improving a golfers swing, comprising:

attaching an arm band only to the golfer's leading arm above the elbow;

connecting a resilient cord from the arm band to an attachment means on the club below the grip;

assuming a stance by holding the grip of the club with both hands so that the club shaft extends between the legs of the golfer;

extending the hands to stretch the cord between the arm band and the shaft until the club head is in a desired position;

maintaining the stretch in the cord; and moving the club back and forth, while maintaining tension in the cord.

6. The method of claim 5, wherein a ball is placed In the normal hitting position relative to the golfers stance, and the golfer makes a short backward and a forward swing to chip the ball while maintaining tension in the cord.

7. The method of claim 5, wherein a ball is placed in the normal hitting position relative to the golfers stance, and the golfer makes a full swing to hit the ball while maintaining tension in the cord.

8. The method of claim 7, wherein after hitting the ball, the golfer changes the connection of the cord to the shaft by one or both of the location along the shaft axis or angular position relative to the shaft axis.

* * * * *